US005509236A

United States Patent [19]

Angles

[11] Patent Number: 5,509,236

[45] Date of Patent: Apr. 23, 1996

[54] SAFETY CANOPY FOR A DOORWAY OR PORTAL

[76] Inventor: Peter V. Angles, 345 S. Reese Pl., Burbank, Calif. 91506

[21] Appl. No.: 252,683

[22] Filed: Jun. 2, 1994

[51] Int. Cl.[6] ..... E04B 1/34

[52] U.S. Cl. ..... 52/74; 52/73; 160/56

[58] Field of Search ..... 52/73, 74, 75, 52/78; 160/19, 29, 56, 83.1

[56] References Cited

U.S. PATENT DOCUMENTS

| | | | |
|---|---|---|---|
| 419,580 | 1/1890 | Allen | 160/56 |
| 919,361 | 4/1909 | Keen | 160/19 |
| 2,814,842 | 12/1957 | O'Morrow | 52/74 |
| 3,138,832 | 6/1964 | Gonnello | 52/78 X |
| 4,429,495 | 2/1984 | Aoki | 49/501 |
| 5,148,640 | 9/1992 | Reilly, Sr. | 52/74 |
| 5,233,800 | 8/1993 | Sasaki et al. | 52/167 R |

*Primary Examiner*—Creighton Smith

*Attorney, Agent, or Firm*—Gene Scott; Patent Law & Venture Group

[57] ABSTRACT

A safety canopy for use with a doorway in a wall is provided. The canopy is rigid and puncture-resistant, and is fixed to the wall and extends from the wall above the doorway downwardly away from the wall to a fixed margin edge, which is positioned approximately level with the top of the doorway. The canopy is positioned and has sufficient size to shelter an individual from objects falling from above the doorway. For additional support of the canopy, a plurality of vertical canopy support braces may be fixed to the canopy margin edge, extending downwardly to a support surface, such as a floor. Vertically oriented pillars may also be included on one side of the wall, extending from the support surface upwardly to the juncture of the wall and canopy. Angled canopy support braces may then be fixed to the canopy margin edge and angled downwardly to intersect the pillars, thereby providing additional support to the canopy for preventing the canopy from collapsing under load. A storage shelf may be positioned within the space defined between the wall and the canopy for supporting emergency materials, such as a first aid kit, a water vessel containing water, food rations, portable lighting, a portable radio, blankets, clothing, and the like.

11 Claims, 3 Drawing Sheets

SAFETY CANOPY FOR A DOORWAY OR PORTAL

FIELD OF THE INVENTION

This invention relates generally to safety shelters, and, more particularly, is directed towards a safety canopy for use with a doorway for sheltering a person from falling objects.

BACKGROUND OF THE INVENTION

It has long been known that one of the safest places to stand in a building or house during an earthquake is under a doorway. The header of the doorway and support therefore tend to be strong enough to support the structure just above it should the rest of the surrounding structure collapse. However, doorways are not that wide, and consequently falling objects may still strike a person standing under the doorway, even if the doorway itself does not collapse. Further, there is typically only room for one or, at most, two persons under the doorway. Still further, in the event of a structural collapse, persons standing in the doorway may become trapped by falling debris and not be able to reach disaster supplies such as first aid kits, potable water, food, blankets, flashlights, and the like.

As such, while standing under a doorway during an earthquake is somewhat safer than not standing under the doorway, there remains a need for a satyr shelter from falling objects during an earthquake. Such a needed shelter would be strong enough to withstand a considerable load, such as the structural collapse of the ceiling or roof above the doorway. Further, such a shelter would provide room for several people, and would include a storage area for allowing quick access to emergency supplies. Such a needed shelter would be relatively easy to install on existing doorways, and would be relatively inexpensive to manufacture. The present invention fulfills these needs and provides further related advantages.

SUMMARY OF THE INVENTION

The present invention is a safety canopy for use with a doorway in a wall. The rigid, puncture-resistant canopy is fixed to the wall and extends from the wall above the doorway downwardly away from the wall to a fixed margin edge. The fixed margin edge is positioned approximately level with the top of the doorway. The canopy is positioned and has sufficient size to shelter an individual from objects falling from above the doorway. For additional support of the canopy, a plurality of vertical canopy support braces may be fixed to the canopy margin edge, extending downwardly to a support surface, such as a floor. Vertically oriented pillars may also be included on one side of the wall, extending from the support surface upwardly to the juncture of the wall and canopy. Angled canopy support braces may then be fixed to the canopy margin edge and extended angularly downwardly to intersect the pillars, thereby providing additional support to the canopy for preventing the canopy from collapsing under load. A storage shelf may be positioned within the space defined between the wall and the canopy for supporting emergency materials, such as a first aid kit, a water vessel containing water, food rations, portable lighting, a portable radio, blankets, clothing, and the like.

The present invention is a shelter from falling objects for use in a doorway during an earthquake, or the like. The present device is strong enough to withstand a considerable load, such as the structural collapse of the ceiling or roof above the doorway. Further, the present invention provides enough space for several people, and includes a storage area for allowing quick access to emergency supplies. The present device is relatively easy to install on existing doorways, and is relatively inexpensive to manufacture. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1B:
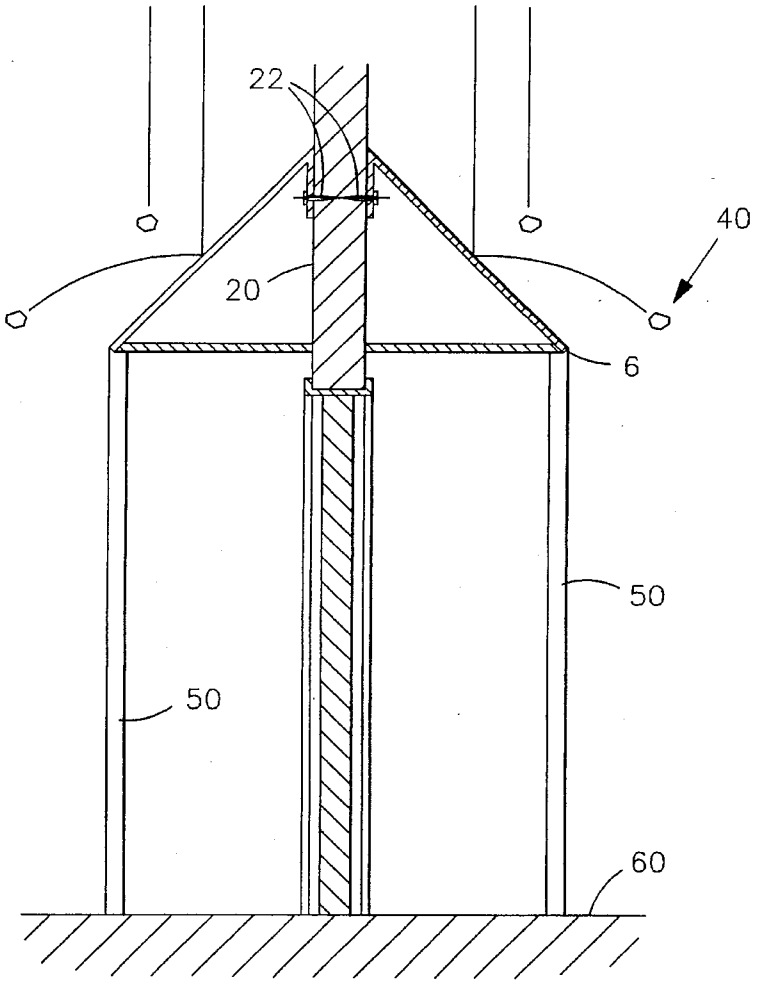
FIG. 1B is a cross-sectional view of the invention, taken generally along lines 1—1 of FIG. 1A, showing the canopy and a plurality of support braces extending downwardly to the support surface from the canopy.
Figure 1A:
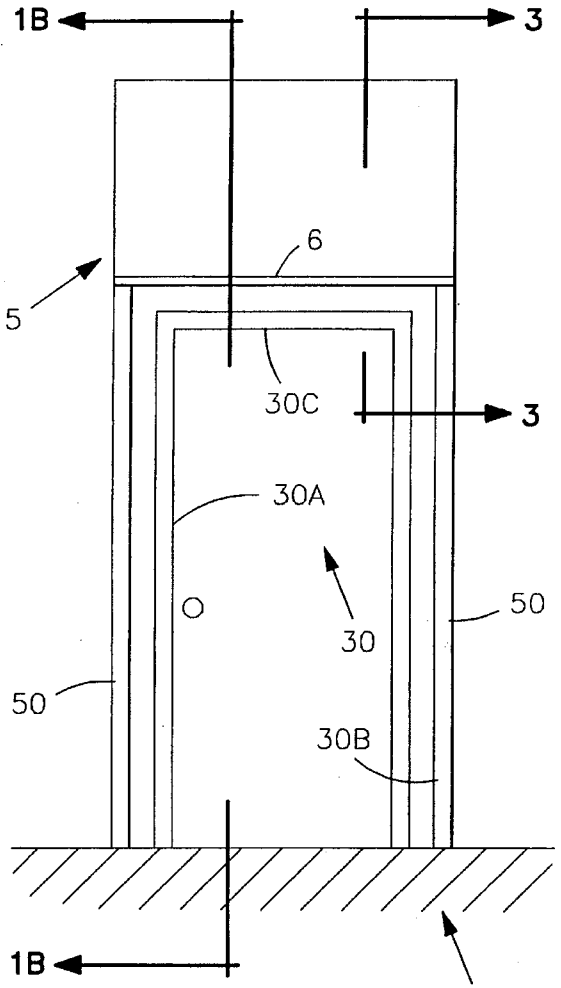
FIG. 1A front elevational view of the invention, illustrating a safety canopy mounted to)wall above a doorway.

FIGS. 1A and 1B show a safety canopy 5 for use with a doorway 10 in a wall 20 of the type having a door jam 30 configured in width and height by a pair of vertical walls 30A,30B and a header 30C respectively. The canopy 5 is made from a suitably strong, rigid material, such as plate metal. The canopy 5 is fixed to the wall 20 by a suitable attachment means 22, such as bolts driven into the header 30C of the wall 20. The canopy 5 comprises a rigid and puncture-resistant surface that extends on a downward angle from the wall 20, above the header 30C, to a fixed margin edge 6. The fixed margin edge 6 protrudes outwardly from the wall 20 at a position approximately level with the header 30C. The canopy 5 is positioned, and has sufficient size, to shelter an individual standing in the doorway 10 from objects 40 falling from above the doorway 10.

Figure 2B:
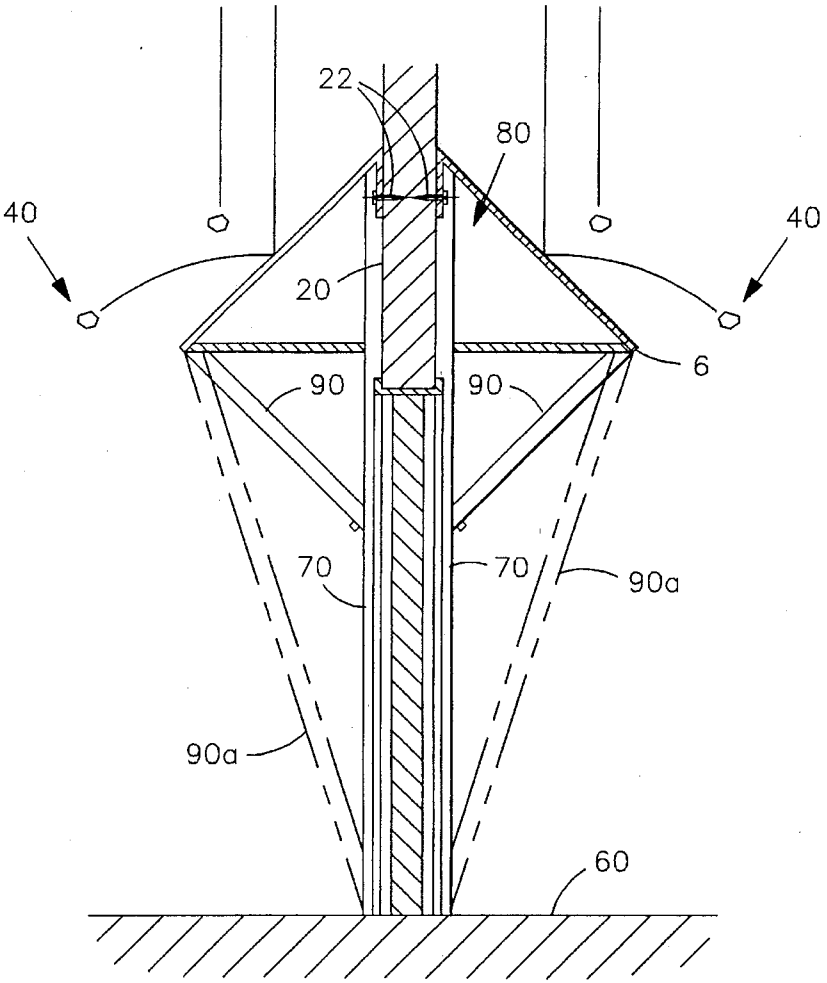
FIG. 2B is a cross-sectional view of the invention, taken generally along lines 2—2 of FIG. 2A, showing the canopy and a plurality of angled canopy support braces extending downwardly to the support pillars from the canopy.
Figure 2A:
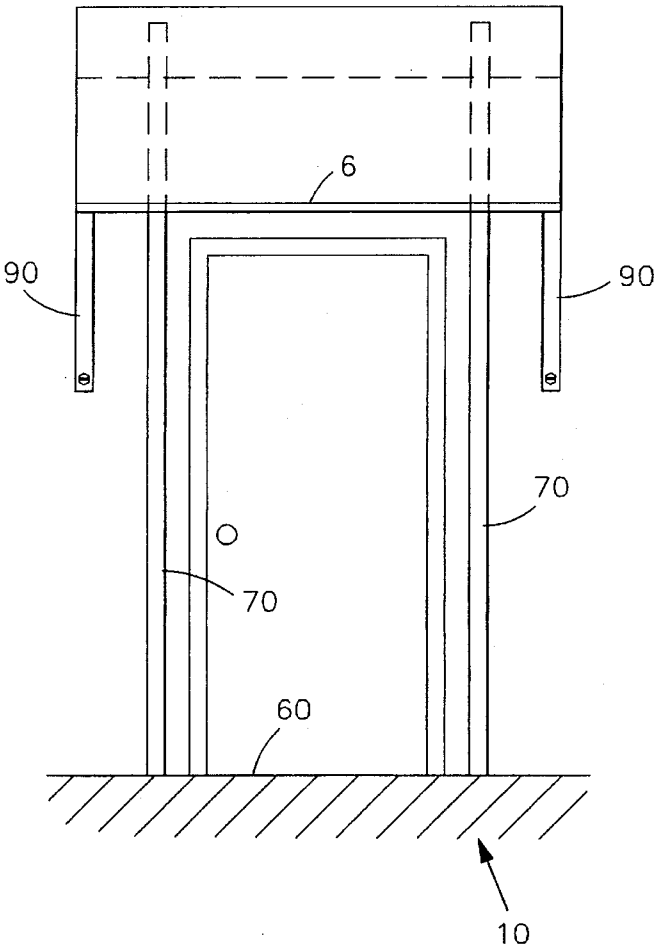
FIG. 2A is a front elevational view of the invention, illustrating the canopy with a pair of vertically oriented support pillars fixed to the wall.

At least one vertical canopy support brace 50 may extend from the canopy margin edge 6 downwardly to a support surface 60. The brace 50 provides support to the canopy 5 for preventing the canopy 5 from collapsing under load. A pair of vertically oriented pillars 70 may be positioned at one side of the doorway 10, extending from the support surface 60 upwardly to a juncture 80 of the canopy 5 and the wall 20. A pair of angled canopy support braces 90 may be fixed to the canopy margin edge 6 and extended angularly downwardly to intersect one of the pillars 70, thereby providing further support to the canopy 5 for preventing the canopy 5 from collapsing under load. Each support brace 90 may intersect the pillar 70 at a midpoint of the pillar 70 or at the intersection of the pillar 70 with the support surface 60 (FIGS. 2A, 2B). Each brace 50,90 and each pillar 70 are made from a suitably rigid and strong metallic material. The pillars 70 may be fixed to the wall 20 with the attachment means 22.

Figure 4:
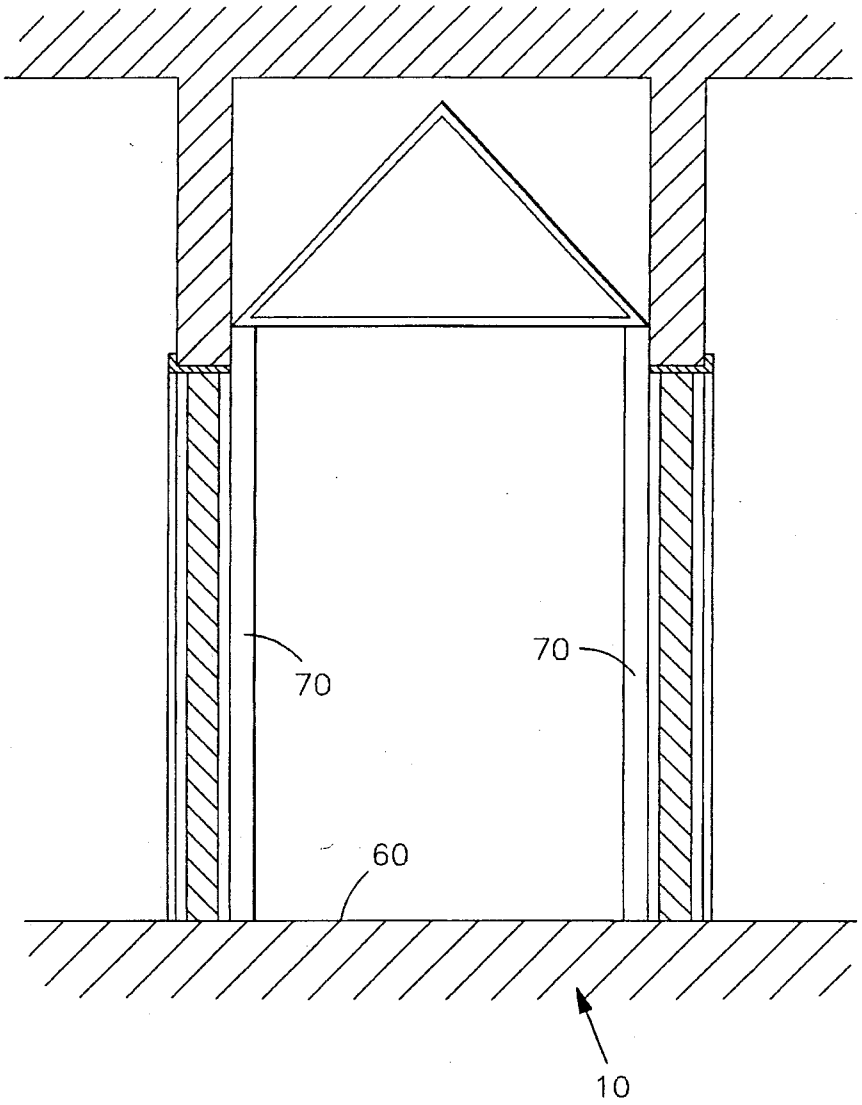
FIG. 4 is an elevational view of the invention, illustrating an embodiment for use between doorways in a hallway.

In one embodiment of the invention, illustrated in FIG. 4, the canopy 5 is a double canopy for use simultaneously above two doorways 10 in a hallway, for example. In such an embodiment, at least four pillars 70 are used to support the canopy 5 above the support surface 60. In another embodiment of the invention, the canopy 5 is shaped to cover two doorways 10 that meet at a right angle (not shown). Such a canopy 5, in a plan view, takes the shape of an isosceles right triangle. In such an embodiment, at least three pillars 70 are used to support the canopy 5 above the support surface 60.

Figure 3:
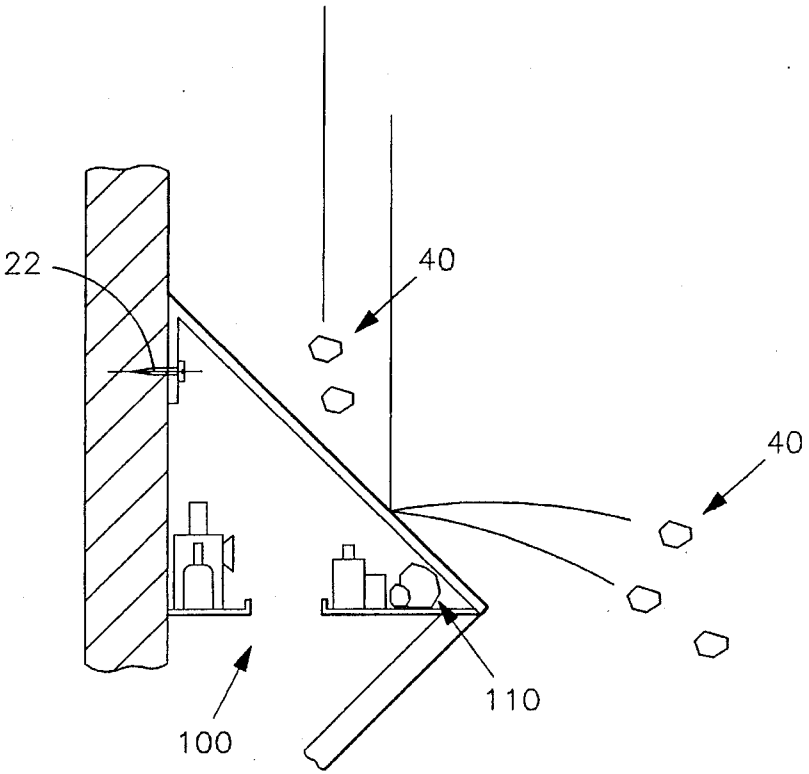
FIG. 3 is a cross-sectional view of the invention, taken generally along lines of FIG. 1A, showing a storage means that includes a horizontal support surface under the canopy.

A storage means 100 may be positioned within the space defined between the wall 20 and the canopy 5. The storage means 100 includes at least one horizontal surface 110 for supporting emergency materials, such as a first aid kit, water vessels containing potable water, food rations, portable lighting, portable radio, blankets, clothing, and the like (FIG. 3).

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A safety canopy for use with a doorway in a wall of the type having a door jam configured in width and height by a pair of vertical walls and a header respectively, the canopy comprising a structural metal plate being rigid and puncture resistant fixed to the wall and extending from the wall above the header, on a downward angle terminating in a margin edge so as to be protruding outwardly from the wall at a position approximately level with the header, the canopy being positioned, and having sufficient size to shelter an individual standing in the doorway from objects falling from above the doorway; the safety canopy further including a pair of vertically oriented pillars each positioned at one side of the doorway and extending from a support surface upwardly to a juncture of the canopy and the wall, and a pair of angled canopy support braces each fixed to the canopy margin edge and extending downwardly to intersect one of the pillars, the braces providing support to the canopy for preventing the canopy from collapsing under load.

2. The safety canopy of claim 1 further including a storage means positioned within the space defined between the wall and the canopy and including at least one horizontal surface for supporting emergency materials.

3. The safety canopy of claim 2 wherein the emergency materials include a selection of emergency items taken from the collection of; a first aid kit, a water vessel containing water, food rations, portable lighting, portable radio, blankets, and clothing articles.

4. The safety canopy of claim 1 wherein the pair of angled canopy support braces intersect one of the pillars at the support surface.

5. A safety canopy for use with a doorway in a wall of the type having a door jam configured in width and height by a pair of vertical walls and a header respectively, the canopy comprising a pair of rigid and puncture resistant surfaces, each surface fixed to one side of the wall and extending on a downward angle terminating in a margin edge so as to be protruding outwardly from the wall at a position approximately level with the header, the canopy being positioned, and having sufficient size to shelter an individual standing in the doorway from objects falling from above the doorway.

6. The safety canopy of claim 5 further including at least one vertical canopy support braces fixed to the canopy margin edge and extending downwardly to a support surface, the braces providing support to the canopy for preventing the canopy from collapsing under load.

7. The safety canopy of claim 5 further including a pair of vertically oriented pillars each positioned at one side of the doorway and extending from a support surface upwardly to a juncture of the canopy and the wall, and two pair of angled canopy support braces each fixed to the canopy margin edge and extending angularly downwardly to intersect the pillars, the braces providing support to the canopy for preventing the canopy from collapsing under load.

8. The safety canopy of claim 5 further including a pair of vertically oriented pillars each positioned at one side of the doorway and extending from a support surface upwardly to the canopy wall juncture, and two pair of canopy support braces each fixed to the canopy margin edge and extending angularly downwardly to intersect the pillars at the support surface, the braces providing support to the canopy for preventing the canopy from collapsing under load.

9. The safety canopy of claim 5 further including a storage means positioned within the space defined between the wall and the canopy and including at least one horizontal surface for supporting emergency materials.

10. The safety canopy of claim 9 wherein the emergency materials include a selection of emergency items taken from the collection of; a first aid kit, a water vessel containing water, food rations, portable lighting, portable radio, blankets, and clothing articles.

11. A safety canopy for use with a doorway in a wall of the type having a door jam configured in width and height by a pair of vertical walls and a header respectively, the canopy comprising a structural metal plate being rigid and puncture resistant fixed to the wall and extending from the wall above the header, on a downward angle terminating in a margin edge so as to be protruding outwardly from the wall at a position approximately level with the header, the canopy being positioned, and having sufficient size to shelter an individual standing in the doorway from objects falling from above the doorway;

a pair of vertically oriented pillars each positioned at one side of the doorway and extending from a support surface upwardly to a juncture of the canopy and the wall, and at least one vertical canopy support brace fixed to the canopy margin edge and extending downwardly to a support surface, the at least one support brace providing support to the canopy for preventing the canopy from collapsing under load;

the safety canopy further including a storage means positioned within a space defined between the wall and the canopy and including at least one horizontal surface for supporting emergency materials.

* * * * *